US006371170B1

(12) United States Patent
Wardle

(10) Patent No.: US 6,371,170 B1
(45) Date of Patent: Apr. 16, 2002

(54) SELECTOR

(75) Inventor: Mike Wardle, County Durham (GB)

(73) Assignee: Bonas Machine Company Limited, Tyne & Wear (GB)

( * ) Notice: Subject to any disclaimer, the term of this patent is extended or adjusted under 35 U.S.C. 154(b) by 0 days.

(21) Appl. No.: 09/787,019

(22) PCT Filed: Sep. 23, 1998

(86) PCT No.: PCT/GB99/03157

§ 371 Date: Mar. 13, 2001

§ 102(e) Date: Mar. 13, 2001

(87) PCT Pub. No.: WO00/17432

PCT Pub. Date: Mar. 30, 2000

(30) Foreign Application Priority Data

Sep. 23, 1998 (GB) ..... 9820661

(51) Int. Cl.[7] ..... D03G 3/20
(52) U.S. Cl. ..... 139/455
(58) Field of Search ..... 139/455

(56) References Cited

U.S. PATENT DOCUMENTS

| | | | | |
|---|---|---|---|---|
| 5,416,375 A | | 5/1995 | Tomoki et al. | |
| 5,462,097 A | * | 10/1995 | Skalka | 139/455 |
| 6,085,803 A | * | 7/2000 | Dewispelaere | 139/455 |

FOREIGN PATENT DOCUMENTS

| | | | |
|---|---|---|---|
| EP | 0 494 044 | | 7/1992 |
| EP | 0 544 527 | | 6/1993 |
| EP | 0 699 787 A | | 3/1996 |
| EP | 0 801 160 A | | 10/1997 |
| WO | 87 01142 A | | 2/1987 |
| WO | WO 93/01337 | * | 1/1993 |

OTHER PUBLICATIONS

Patent Abstracts of Japan. vol. 012, No. 351 (E–660), Sep. 20, 1988; and JP 63 107468 A (Meldensha Electric Mfg. Co. Ltd). Jun. 12, 1988.

* cited by examiner

*Primary Examiner*—Andy Falik
(74) *Attorney, Agent, or Firm*—Dann, Dorfman, Herrell and Skillman; Henry H. Skillman

(57) ABSTRACT

An electronic jacquard including a plurality of elongate heald hooks (1*a*, 1*b*) movable longitudinally between upper and lower shed positions and a plurality of electrically operable selection devices (50) for co-operation with the heald hooks (1*a*, 1*b*) for selectively retaining the heald hooks (1*a*, 1*b*) at one of said shed positions, each selection device including a latch (4*a*, 4*b*) movable between a latched position and a non-latched position, the latch (4*a*, 4*b*) when at said latched position being capable of latching engagement with the heald hook (1*a*, 1*b*) in order to retain it at said shed position, and an ultrasonic cyclic motor (55), preferably a piezo-electric motor, drivingly arranged to move the latch (4*a*, 4*b*) from its non-latched position to its latched position.

10 Claims, 4 Drawing Sheets

SELECTOR

FIELD OF THE INVENTION

The present invention relates to an electronic jacquard, in particular for controlling warp selection in a weaving loom.

BACKGROUND OF THE INVENTION

In conventional electromagnetic jacquards, see for example EP 0188074, the jacquard selectively controls raising and lowering of warp yams between upper and lower shed positions.

In EP 0188074 a pair of hooks are connected via a pulley to one or more harness cords which in turn is (are) connected to healds through which the warp yarns pass.

The jacquard is provided with selection devices which selectively operate to capture one or other of a pair of hooks when that hook is at its uppermost position. This action, in co-operation with the pulley, results in the harness cord raising or retaining the heald and warp yarn at the top of the V shaped shed opening on the warp bed on the loom. Not to select/capture the hook results in the heald/warp lowering or remaining at the bottom of the V shaped shed opening.

In other types of jacquard, a single hook is connected to the harness cord such that raising/lowering of the single hook directly results in raising/lowering of the heald.

SUMMARY OF THE INVENTION

According to one aspect of the present invention there is provided an electronic jacquard including a plurality of elongate heald hooks movable longitudinally between upper and lower shed positions and a plurality of electrically operable selection devices for co-operation with the heald hooks for selectively retaining the heald hooks at one of said shed positions, each selection device including a latch movable between a latched position and a non-latched position, the latch when at said latched position being capable of latching engagement with the heald hook in order to retain it at said shed position, and an ultrasonic cyclic motor, preferably a piezo-electric motor, drivingly arranged to move the latch from its non-latched position to its latched position.

Preferably the latch is biased to its non-latched position so as to be capable of moving from its latched position to its non-latched position under the influence of said bias.

Preferably the latch is mounted on a support arm which is formed of a resilient material, preferably spring steel, the arm being fixedly mounted at one end to a body of the selection device and carrying said latch at its opposite end.

Preferably the piezo-electric motor is arranged to move an actuator member which engages the support arm, preferably at a location intermediate the ends of the arm, in order to move the latch to its latched position.

Preferably, the hooks are arranged in pairs for raising/lowering a harness pulley, and each selection device preferably includes a pair of latches and a single motor arranged to control movement of both latches to their respective latched positions.

Preferably each latch is arranged to be rotated upon retaining engagement with a hook when at its latch position, biasing mans being provided to resist said rotation.

According to another aspect of the present invention there is provided an electronic jacquard including a plurality of elongate heald hooks movable longitudinally between upper and lower shed positions and a plurality of electrically operable selection devices for co-operation with the heald hooks for selectively retaining the heald hooks at one of said shed positions, each selection device including a latch movable between a latched position and a non-latched position, the latch when at said latched position being capable of latching engagement with the heald hook in order to retain it at said latch position, the latch when at said latched position being movable between a retention position and a release position, biasing means being provided to resiliently bias the latch to its release position, the hook and latch co-operating such that the hook on engagement with the latch causes the latch to move to its retention position against said resilient bias, and an electrically operable actuator for selectively moving the latch to its latched position.

Preferably the actuator is an ultrasonic cyclic motor, preferably a piezoelectric motor.

DESCRIPTION OF THE DRAWINGS

Reference is now made to the accompanying drawings, in which.

DESCRIPTION OF THE PREFERRED EMBODIMENT

Figure 1:
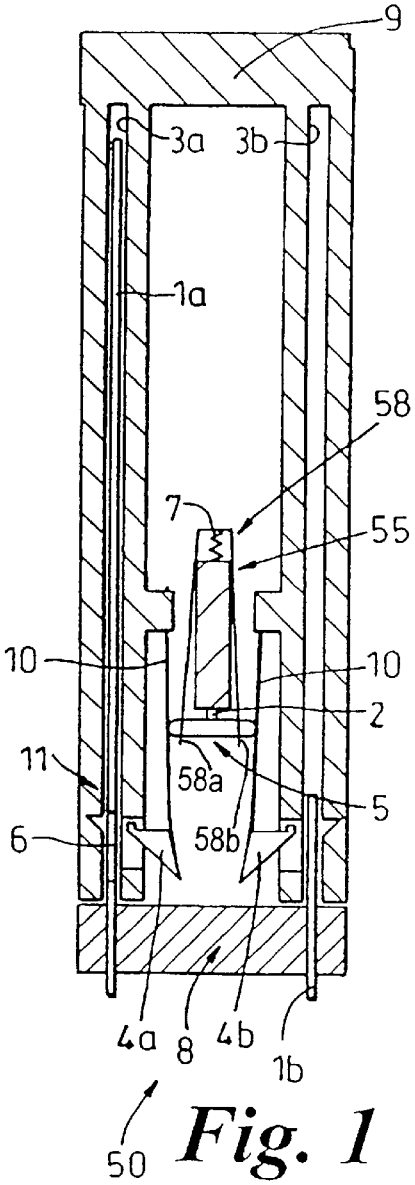
FIG. 1 is a schematic side view of an embodiment according to the present intention illustrated in a first operational position.

Referring initially to FIG. 1, there is shown a selection device 50 arranged to control a pair of heald hooks 1*a*, 1*b* which operate to raise and lower a harness pulley (not shown).

The selection device 50 includes a body 9 made for example from plastic, having guide channels 3*a*, 3*b* for guiding longitudinal movement of the upper portion of the heald hooks 1*a*, 1*b* respectively.

The selection device 50 includes an electrically operable actuator 55 which is arranged to drive an actuator member 5 either to the left or right as required. Preferably the actuator 55 is an ultrasonic cyclic motor, preferably a piezo-electric motor having an elongate casing 11 from one end of which projects a drive output in the form of a drive finger 2. The actuator member is preferably in the form of a block or rod of a suitable material which is connected at opposite ends to arms 58*a*, 58*b* of a bracket 58. The arms 58*a*, 58*b* are movable to enable movement of the actuator member 5 to the left or right of casing 111. In addition the bracket is biased by biasing means preferably in the form of a spring 7, in order to maintain positive contact between the drive finger 2 and the actuator member 5.

Figure 9:
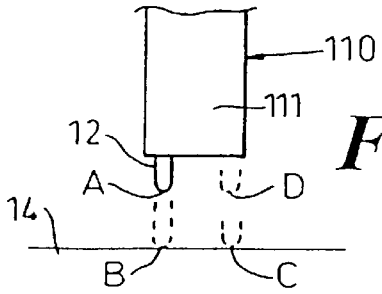
FIG. 9 is a schematic diagram illustrating the principle of operation of an ultrasonic motor as used in the present invention.

Referring initially to FIG. 9, there is shown an ultrasonic motor 110 including a casing 111 which houses a drive finger 12. The drive finger 12 is arranged to cyclically move along a cyclic path from a retracted position A (as shown) to an extended position B (shown in broken lines) and then whilst in its extended position, to the position C and then retracted to position D and then whilst in its retracted position, to position A.

The finger 12 is driven at high speed through the cycle of positions A,B,C and D, preferably by piezo-electric elements (not shown) housed within the casing 111.

The direction of movement through the cycle may be A to B to C to D or may be reversed, viz A to D to C to B depending upon the applied electrical current.

By placing a member 14 to be driven in the path of the finger 12 whilst it moves between positions B to C (or vice versa), it is possible for the finger 12 to drive, in a stepwise manner, the member 14 in the same direction of travel.

This type of motor operates at high speeds, typically at cycles of between 20 to 140 KHz. The motor typically has a cross-sectional dimension of about 8 mm×4 mm and a length of about 25 mm.

Figure 2:
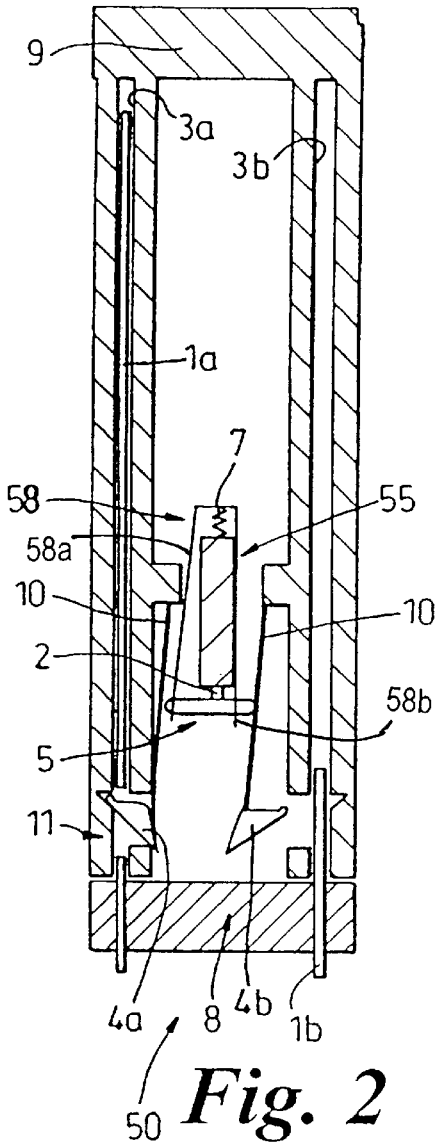
FIGS. 2 to 7*a*/*b* are similar views to FIG. 1 showing the embodiment in different operational positions.

The selection device 50 also includes a pair of latches 4*a* and 4*b* which are each movable from a non-latched position (as seen in FIG. 1) to a latched position (as seen by reference to the latch co-operating with heald hook 1*a* in FIG. 2).

Each of the latches 4*a* and 4*b* is mounted on one end of a resilient arm 10, the opposite end of arm 10 being fixedly mounted to the body 9. Accordingly the resilient arm 10 is arranged to act as biasing means for biasing each of the latches 4*a* and 4*b* to its non-latched position.

Preferably each of the latches 4*a* and 4*b* is formed from a moulded plastics material. Preferably each arm 10 is formed from a spring strip material such as spring steel.

Figure 8:
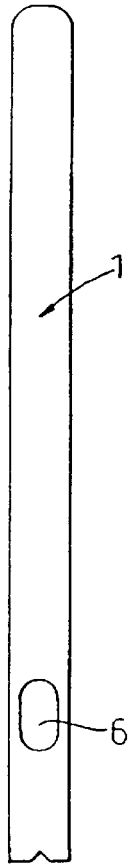
FIG. 8 is a front view of an upper portion of a heald hook shown in FIG. 1.

The actuator member 5 is arranged to engage the arm 10 at a position intermediate the ends of the arm 10 and so enables a suspended latch 4*a* or 4*b* to be pushed through a hole 6 formed in the hook 1 (see FIGS. 1 and 8). Thus each selection device 50 when actuated acts to move latches 4*a* and 4*b* into the holes 6 in their respective hooks 1*a* and 1*b* and thus capture the hook when required. The length of the hook 1 above the hole 6 is not important but the hole 6 must align with the latches 4*a* and 4*b* when the hook is raised to its uppermost position.

In FIG. 1 the motor 2 has moved the actuator member 5 to a central position where the latches 4*a* and 4*b* are not required to engage with the hole 6 in either hook 1. Hook 1*a* is shown at its uppermost position and hook 1*b* is at its lowest position.

FIG. 2 shows a latch 4*a* at its latched position whereat it has been pushed through the hole 6 of hook 1*a* by actuator member 5 following the operation of motor 2 moving the actuator member 5 to the left. Since both latches 4*a* and 4*b* are biased towards the centre, ie. to their non-latched position, then latch 4*b* has been allowed to move towards the left moving further away from hook 1*b*.

Figure 3:
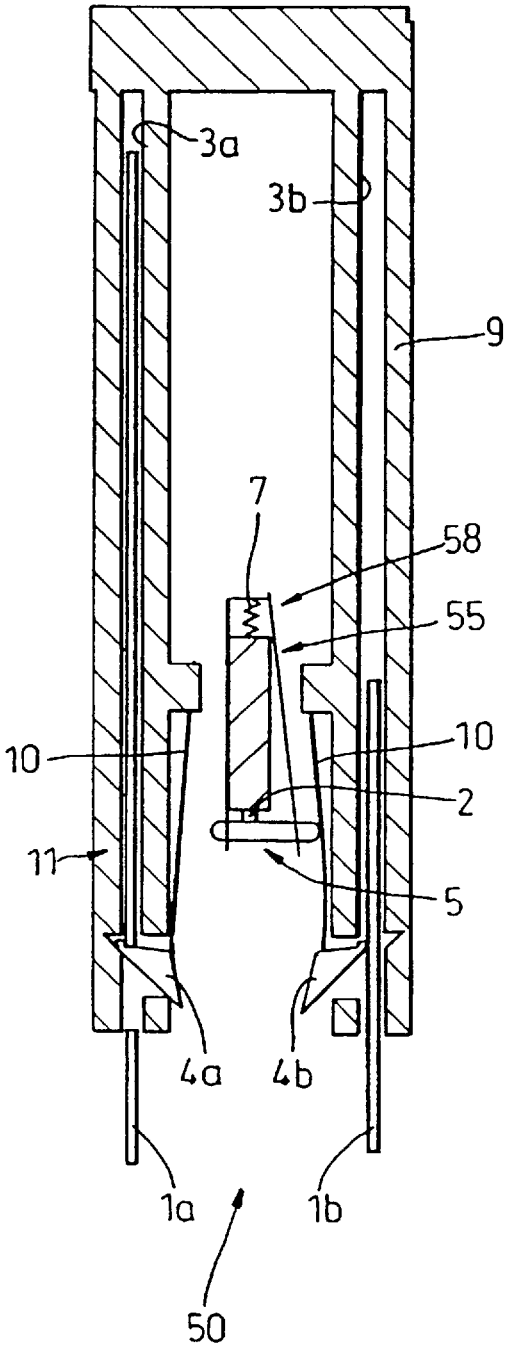

FIG. 3 illustrates an example of pre-selecting latching of a heald hook.

Figure 4:
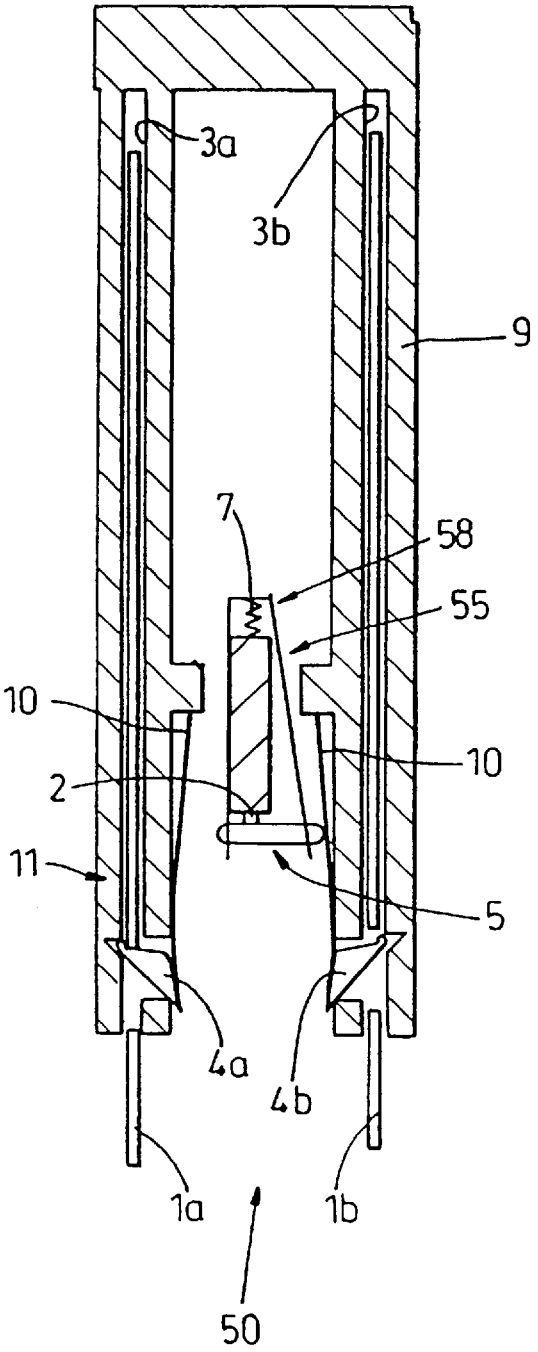

As required by prior art EP 0188074 at some time later in the cycle from the selection point, the hook 1*a* has been captured by latch 4*a* at its uppermost position and hook 1*b* has been raised by its lifting member up from the lowest position of hook travel. Since in this case it is necessary to retain the second hook 1*b* at its upper position, the motor 2 has been actuated to move the actuator member 5 to the right. As illustrated in FIG. 3, this has caused latch 4*b* to engage the upper portion of hook 1*b* and has thus pre-loaded the latch 4*b* ready to engage hole 6 in hook 1*b* when the hook is raised to the uppermost position (this is shown in FIG. 4). It is not essential but preferable that this pre-load function is used in high speed jacquards.

In accordance with the preferred embodiment of the invention, the latch 4*a* has been mechanically interlocked with hook 1*a* and no longer requires actuator member 5 to hold it at its latch position.

For practical reasons there may be a neutral position wherein actuator member 5 is located central to body 9 and at this position neither latch 4*a* nor 4*b* is pushed by member 5; ie. both latches are in their non-latched position. However, this neutral condition is not essential. It will be appreciated that the member 5 does not require a neutral position between latches 4*a* and 4*b* for the selection device to operate correctly. For example to avoid retention of hook 1*a*, motor 2 is actuated to move member 5 to the right against latch 4*b* whether or not latch 4*b* is engaged in hook 1*b* as the spring component of latch 4*b* takes up the travel of block 5 to the right.

Figure 6:
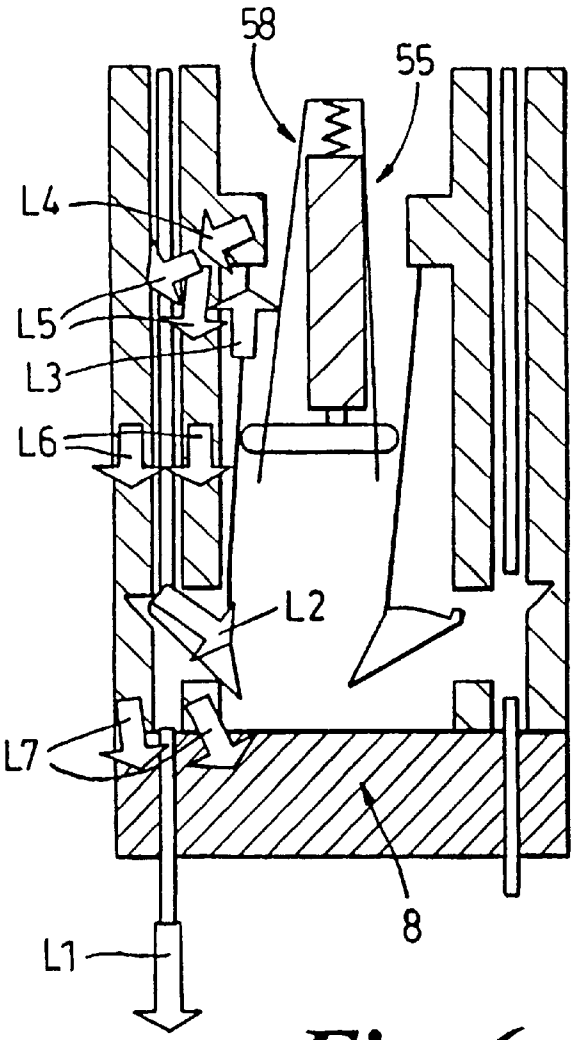
Figure 5:
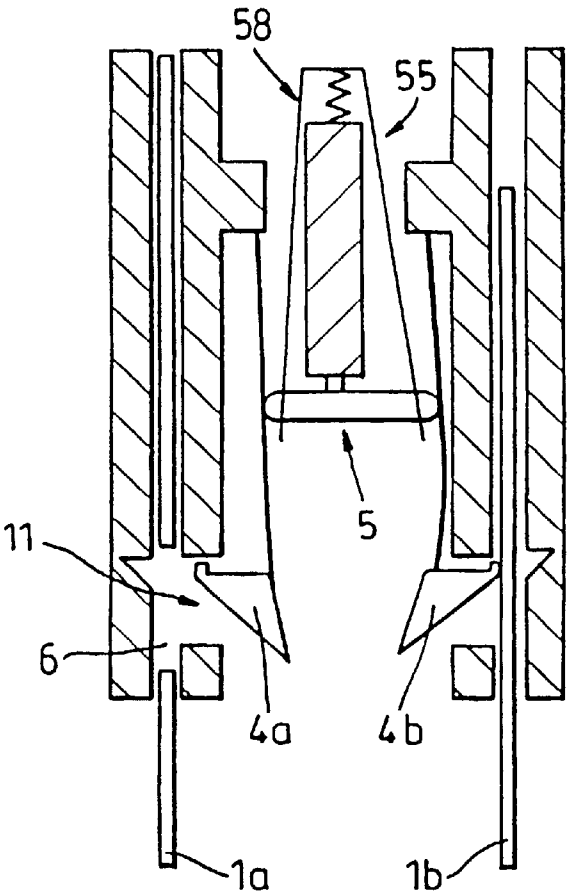

FIG. 6 illustrates the mechanical load path.

Starting with the downward force on the hook L1 the load is transferred via the latch L2, arm L3, latch anchor L4, selector body L5, L6 and finally the interface contact between the selector body and the frame L7.

Apart from friction contact between the spring arm L3 and the actuator member 5, the load path misses out the actuator 55 and member 5 thus avoiding any distortion of the actuator material or connecting wires. The actuator life is not effected by the selector loads allowing the selector body to be manufactured in a compact, flexible scale.

Figure 7A:
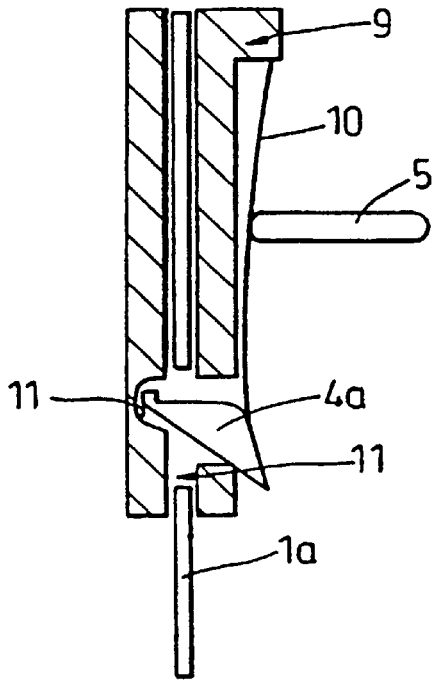
Figure 7B:
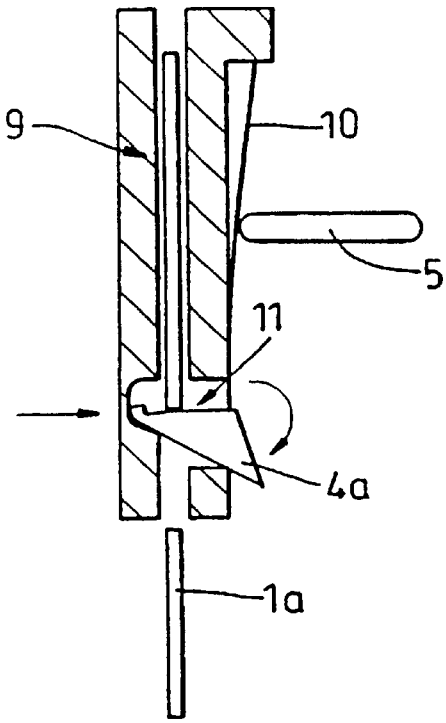

In FIGS. 7*a*, 7*b* there is illustrated an example of achieving impact reduction.

It is normal for jacquard hooks to be captured by stiff latches. This has the effect of suddenly stopping the harness while it is in motion causing an impact on the latch and the harness.

Similarly, when the hook is lifted from the latch there is a sudden motion of the harness which results in a steep force change in the selector device and that member of the jacquard used to lift the hook.

Both the forces produced when retaining the hook on the latch and the forces produced when the hook is lifted from the latch can be reduced by incorporating a resilient latch design. FIG. 7*a* shows the position of latch 4*a* before the hook 1*a* has moved down onto the latch. This position is referred to as the release position. A short time later the hook 1*a* has moved down and the position of the latch 4*a* is changed to that shown in FIG. 7*b*. This position is referred to as the retention position.

The hook 1*a* has loaded the latch 4*a* which due to the shape of the recess 11 in the selector body 9 and the resilience of the spring arm 10 has allowed the latch 4*a* to rotate creating a torque reaction which reduces the deceleration of the hook and harness inertia and thus impact.

Similarly when the hook is raised from the latch by its lifting member on the jacquard the situation changes from diagram 7*b* to that of 7*a*. During this time the hook lifting is assisted by the reaction force from latch 4*a* thus reducing the force on the hook lifting member and reducing the rate of change of force on the latch.

By this means the resilient construction of the latch 4*a* and its recess 11 reduce the effects of capturing and releasing the hook 1*a*.

It will be appreciated that the preferred embodiment of the invention enables operation of two movable latches for capturing either or both co-operating hooks at the top of their stroke utilising a single ultrasonic piezo motor driving an actuator member against the spring arm carrying the latches.

The latches have a mechanical means of interlocking with the hook such that once engaged, the actuator member may be removed from the spring arm while the latch is carrying the downward load of the hook.

What is claimed is:

1. An electronic jacquard including a plurality of elongate heald hooks movable longitudinally between upper and lower shed positions and a plurality of electrically operable selection devices for cooperation with the heald hooks for selectively retaining the heard hooks at one of said shed positions, each selection device including a latch movable between a latched position and a non-latched position, the latch when at said latched position being capable of latching engagement with the heald hook in order to retain it at said shed position, and an ultrasonic cyclic motor drivingly arranged to move the latch from its non-latched position to its latched position.

2. A jacquard according to claim 1 wherein each motor includes a drive output comprising a drive finger which is driven cyclically along a cyclic path.

3. A jacquard according to claim 1 wherein the latch is biased to its non-latched position so as to be capable of moving from its latched position to its non-latched position under the influence of said bias.

4. A jacquard according to claim 3 wherein the latch is mounted on a support arm which is formed of a resilient material, the arm being fixedly mounted at one end to a body of the selection device and carrying said latch at its opposite end.

5. A jacquard according to claim 4 wherein said motor is arranged to move an actuator member which engages the support arm in order to move the latch to its latched position.

6. A jacquard according to claim 5 wherein said actuator engages the support arm at a location intermediate the ends of the arm.

7. A jacquard according to claim 4 wherein said resilient material is spring steel.

8. A jacquard according claim 1, for use with a loom having a harness pulley, wherein said hooks are arranged in pairs for raising/lowering the harness pulley, and each selection device includes a pair of latches and a single motor arranged to control movement of both latches to their respective latched positions.

9. A jacquard according to claim 1 wherein each latch is arranged to be rotated upon retaining engagement with a hook when at its latch position, each latch including biasing means to resist said rotation.

10. A jacquard according to claim 1 wherein said motor is a piezo-electric motor.

* * * * *

UNITED STATES PATENT AND TRADEMARK OFFICE

CERTIFICATE OF CORRECTION

PATENT NO. : 6,371,170 B1
DATED : April 16, 2002
INVENTOR(S) : Wardle

It is certified that error appears in the above-identified patent and that said Letters Patent is hereby corrected as shown below:

Title page,
Item [22], the PCT filing date should be -- September 23, 1999 --;

Column 1,
Line 11, "yarms" should be -- yarns --.

Signed and Sealed this

Third Day of June, 2003

JAMES E. ROGAN
*Director of the United States Patent and Trademark Office*